United States Patent [19]

Elmore

[11] Patent Number: 4,654,008

[45] Date of Patent: Mar. 31, 1987

[54] AUTOMATIC WEAPONS EFFECT SIGNATURE SIMULATOR

[75] Inventor: Lester C. Elmore, Portola Valley, Calif.

[73] Assignee: Pulsepower, Inc., San Carlos, Calif.

[21] Appl. No.: 485,597

[22] Filed: Apr. 18, 1983

[51] Int. Cl.[4] ..... F41F 27/00

[52] U.S. Cl. ..... 434/16; 42/55; 89/7

[58] Field of Search ..... 434/16, 19, 21, 18; 89/7; 42/54, 55

[56] References Cited

U.S. PATENT DOCUMENTS

| | | | |
|---|---|---|---|
| 2,094,854 | 10/1937 | Smith | 42/55 X |
| 3,346,984 | 10/1967 | Lohr | 89/7 X |
| 3,728,937 | 4/1973 | Nelson et al. | 89/7 |
| 4,217,717 | 8/1980 | Canty et al. | 89/1.1 X |
| 4,380,437 | 4/1983 | Yarborough, Jr. | 434/18 |
| 4,416,630 | 11/1983 | Hagen et al. | 434/16 |

*Primary Examiner*—William H. Grieb

*Attorney, Agent, or Firm*—Donald C. Feix

[57] ABSTRACT

An automatic weapons effects simulator (AWES) reproduces the visual and acoustic signatures associated with the firing of a weapon used in combat troop engagement simulation. The AWES is directly integrated into the weapon and allows the weapon operator to utilize the basic weapon mechanism in the same manner as with the original parts and at a cost advantage as compared to the cost of blank ammunition.

14 Claims, 17 Drawing Figures

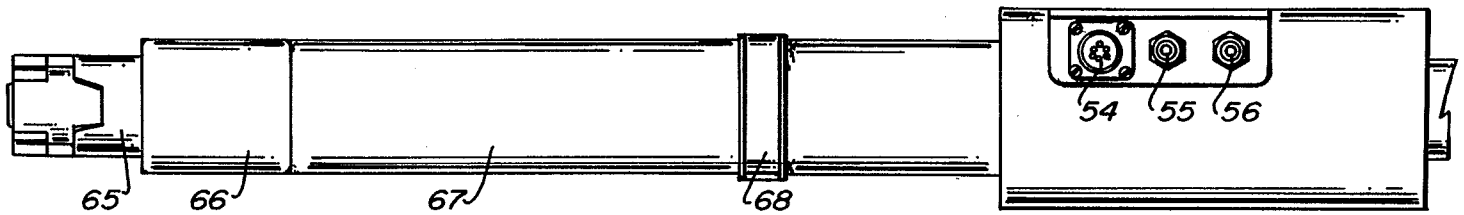
FIG. 7-C
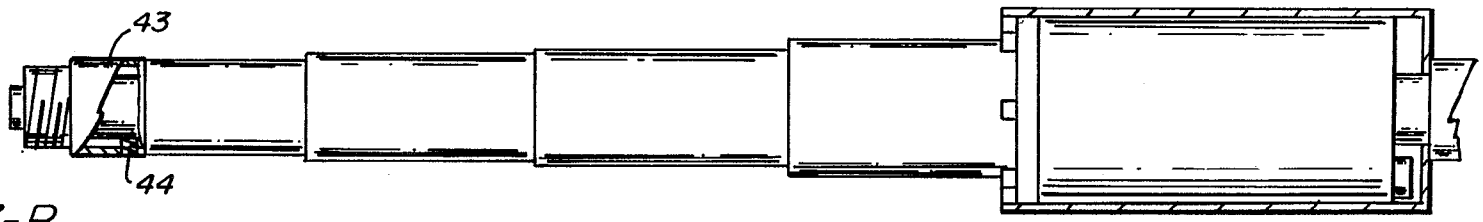
FIG. 7-B
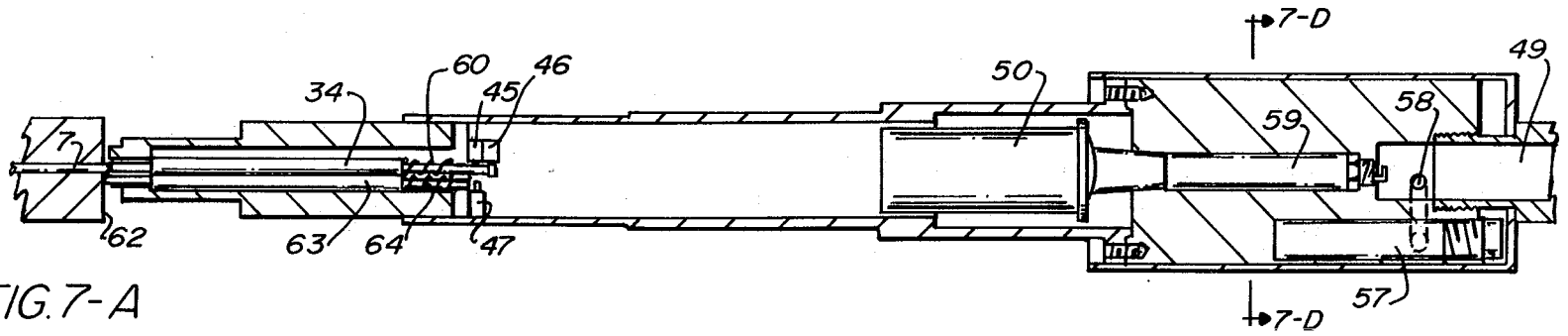
FIG. 7-A

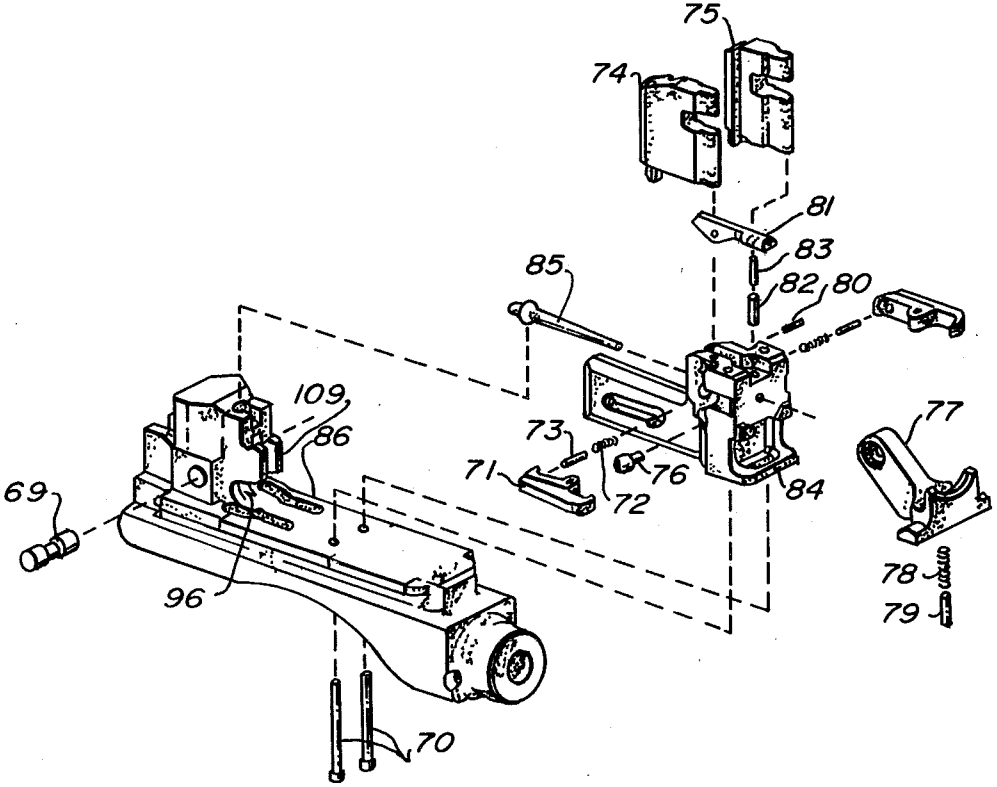
FIG. 10
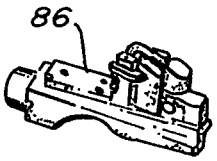
FIG. 9
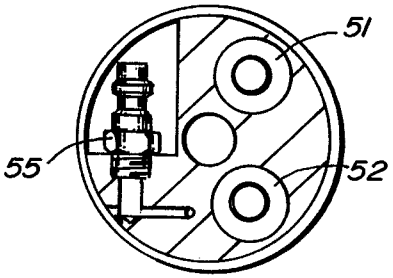
FIG. 7-D
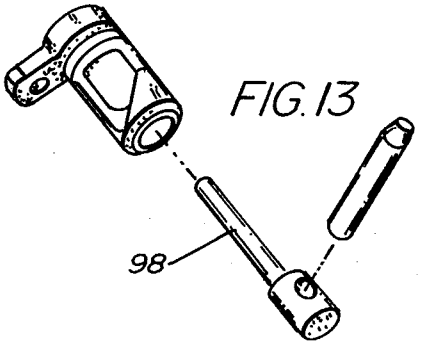
FIG. 13

AUTOMATIC WEAPONS EFFECT SIGNATURE SIMULATOR

The government has rights in this invention pursuant to Contract No. 61339-78-C-0149, awarded by the Naval Training Equipment Center.

BACKGROUND OF THE INVENTION

1. Field of the Invention

The invention relates to a simulator capable of reproducing the visual and acoustic signatures associated with firing of a weapon. The invention relates particularly to a simulator that can be directly integrated into a weapon allowing the weapon operator to utilize the basic weapon mechanism yet realize the cost advantages associated with simulating weapon acoustic and visual signatures.

2. Description of the Prior Art

Traditionally weapon signatures have been simulated by firing of bland rounds of ammunition. Operation of the weapon using blanks ordinarily requires use of a blank firing adaptor to implement weapon function in the absence of recoil generated by the projectile, in recoil operated weapons, or by sustained high pressure in gas operated weapons. In some installations the recoil adaptor is cumbersome, affects weapon balance, and suppresses visual and acoustic signature of the blank round and therefore adversely affects operation of the weapon.

As an alternative to use of blanks, particularly in the simulation of hostile fire, various devices capable of simulating weapon visual and acoustic signatures have been made which employ propane and oxygen as the energy source. These devices are independent units which replace the weapon being simulated on a one-to-one basis and do not involve integration of the simulator into the weapon as does the present invention.

The U.S. Army is implementing a major program to improve combat troop effectiveness by means of engagement simulation, considered to be more beneficial to soldier and commander than any other training. Engagement simulation is implemented using a series of training aids which have validated the effectiveness of the new training techniques. Troops trained using engagement simulation, compared to control groups, show a marked improvement in overall effectiveness.

The most advanced of these training devices is the Multiple Integrated Laser Engagement System (MILES). MILES uses an eye safe coded laser transmitted to fire "laser bullets" simulating the effects of live ammunition against troops and vehicles equipped with appropriate detectors. MILES logic indicates to troops and commanders the simulated effect on target whether miss, hit, or kill. For the first time engagements can be simulated where results are not dominated by subjective judgment of controllers.

A key requirement of engagement simulation is cueing. Individuals and vehicles employing MILES only know they are under fire by means of the audio and visual signal of a blank round which also triggers the MILES laser. Engagement simulation thus has dramatically increased the consumption of blank ammunition. Expansion of MILES applications, particularly in heavy machine gun calibers, indicates that the cost of blank ammunition will become prohibitive.

The present invention describes a weapon signature simulator which can be directly integrated into a weapon to realize economical operation concurrent with the training advantages associated with the use of an actual weapon rather than a replacement simulator which does not accurately simulate normal weapon functions.

OBJECTS OF THE INVENTION

It is a primary object of the present invention to combine the technology of propane/oxygen signature simulators, as described, with the technology of automatic weapons which will make maximum use of the benefits of both technologies and result in low cost simulation of automatic weapon visual and acoustic signatures.

It is another object of the present invention to directly integrate the operation of the signature simulator into the weapon such that the weapon user operates the simulator equipped weapon in exactly the same manner as he would without the simulator. Weapon functions which control simulator operation include triggering, safety, rate of fire, single shot or burst fire operation, and operating handle, as well as simulation of the delays associated with reloading of the weapon.

It is another object of the present invention to replace certain weapon components with those of the simulator such that the simulator can be directly integrated into the weapon.

It is another object of the present invention to make a single simulator applicable to more than one weapon.

SUMMARY OF THE INVENTION

The automatic weapons effect signature simulator (AWESS) in a preferred form of the present invention incorporates three functional elements which are integrated into the weapon. These elements consist of (1) an expendables supply unit, (2) a chamber barrel assembly, and (3) a receiver unit. While the functions and characteristics of each of these elements, in the preferred form of the invention, are as described below this is not meant to preclude alternative arrangements of functions among the three elements where dictated by the physical and operating characteristics of a particular weapon.

The expendables supply unit contains fuel, oxygen and batteries necessary for operation of the simulator. Fuel normally is liquid propane although other fuels such as MAPP gas, butane, or propylene will function as well and should be considered interchangeable with propane. The propane and oxygen are ignited by an electric spark which is generated by the batteries.

The expendables supply unit also contains propane and oxygen pressure regulators required to establish gas pressures necessary for proper combustion in the simulator. In its preferred form, the expendable supply unit contains the mode select switch, valve and spark drive circuitry, round counter, and ammunition status display.

The chamber barrel unit incorporates the fuel and oxygen flow control valves which are electrically operated in the preferred form of the invention, but can also be mechanically driven. The chamber barrel unit also contains the fuel and oxygen mixing chamber, combustion chamber, switches for trigger, rate of fire, and reset, and the necessary adaptors to permit use of a single chamber barrel unit on more than one weapon.

The receiver unit of the simulator contains those elements and functions which most directly interact with weapon operation. In some cases parts of the weapon are removed and replaced by simulator parts such that weapon functions can be implemented by the simulator. Weapon functions which must be implemented by the simulator include operation of the trigger, safety, rate of fire switch, or single shot or burst fire modes of operation.

The simulator is integrated into the weapon by first removing those parts of the weapon which will not be required when the weapon is operated as a simulator. Appropriate simulator parts are then incorporated into the weapon such that normal actions necessary for its operation now implement function of the simulator. Ordinarily the chamber barrel assembly and receiver units are directly integrated in the weapon and the expendables supply unit connected to the chamber barrel assembly by appropriate fuel, oxygen and electrical lines and connectors. After switching on the simulator power supply and fuel and oxygen valves, the simulator can be made to function using the normal controls of the weapon including trigger, safety, rate of fire switch, single shot or burst fire mode selector, and weapon operating handle.

Other and further objects of the present invention will be apparent from the following description and claims and are illustrated in the accompanying drawings which, by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWING VIEWS

FIG. 1 is a side elevation schematic view showing an automatic weapons effect signature simulator (AWESS) integrated in an M2 weapon in accordance with one embodiment of the present invention. FIG. 1 shows the three functional elements which are integrated into the weapon. These elements comprise the expendables supply unit, the chamber barrel assembly and the receiver unit.

FIG. 7A is a side elevation view in cross section showing the chamber barrel assembly for the AWESS in both the M2 and M85 applications.

FIG. 7B is an elevation view showing the adapter for the M2.

FIG. 7C is an elevation view showing the adaptors for the M85 and also shows the quick disconnects for the gas and electrical connections.

FIG. 7D is a cross section view taken along the line and in the direction indicated by the arrows in FIG. 7D—7D in FIG. 7A.

FIG. 9 shows the bolt assembly for the M85.

FIG. 10 shows the components which are removed and the components which are retained by AWESS operation of the M85.

FIG. 12 shows the M85 elements for the low rate of fire mode.

FIG. 13 shows the M85 safety assembly.

DESCRIPTION OF THE PREFERRED EMBODIMENTS

Figure 1:
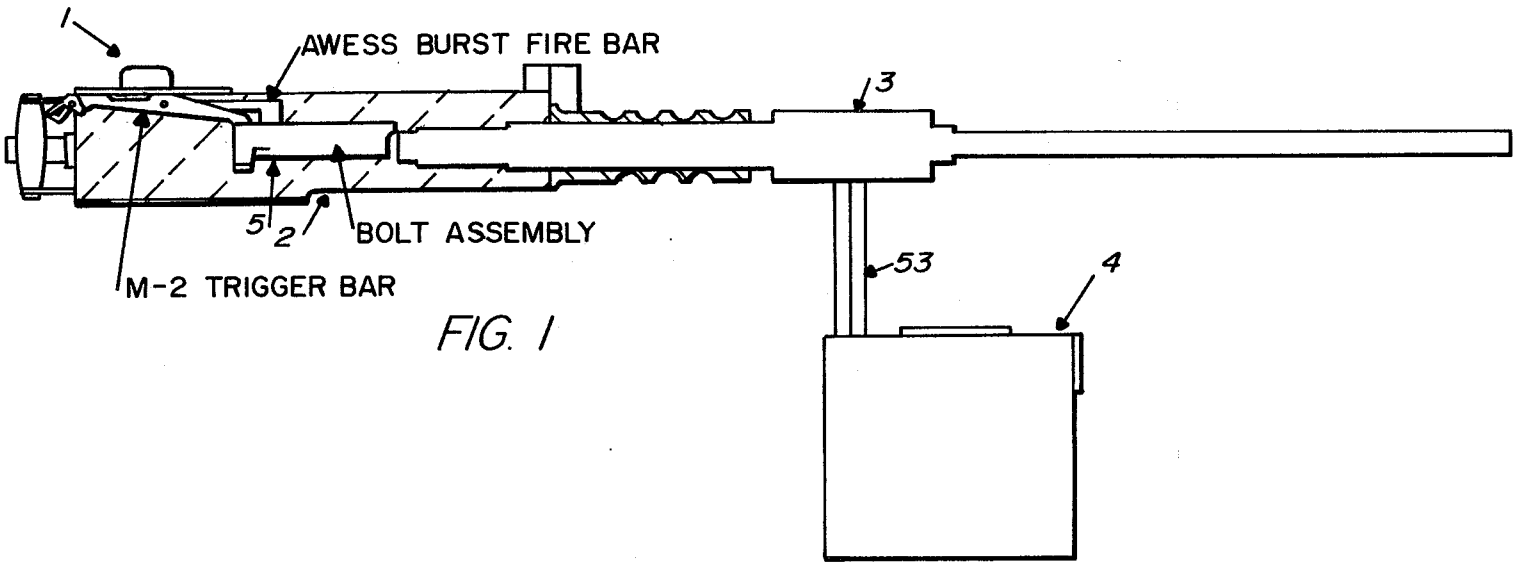

An Automatic Weapons Effects Signature Simulator, hereinafter referred to as AWESS, constructed in accordance with one embodiment of the present invention is indicated generally by the reference numeral 1 of FIG. 1, showing schematically the AWESS elements which must be incorporated in an automatic weapon to convert it to simulator operation.

The AWESS equipped weapon 1 is illustrated as a machine gun suitable for vehicle or ground mount applications. The present invention can also be embodied in other types of weapons such as hand held weapons, or automatic, or vehicle mounted cannons.

Figure 2:
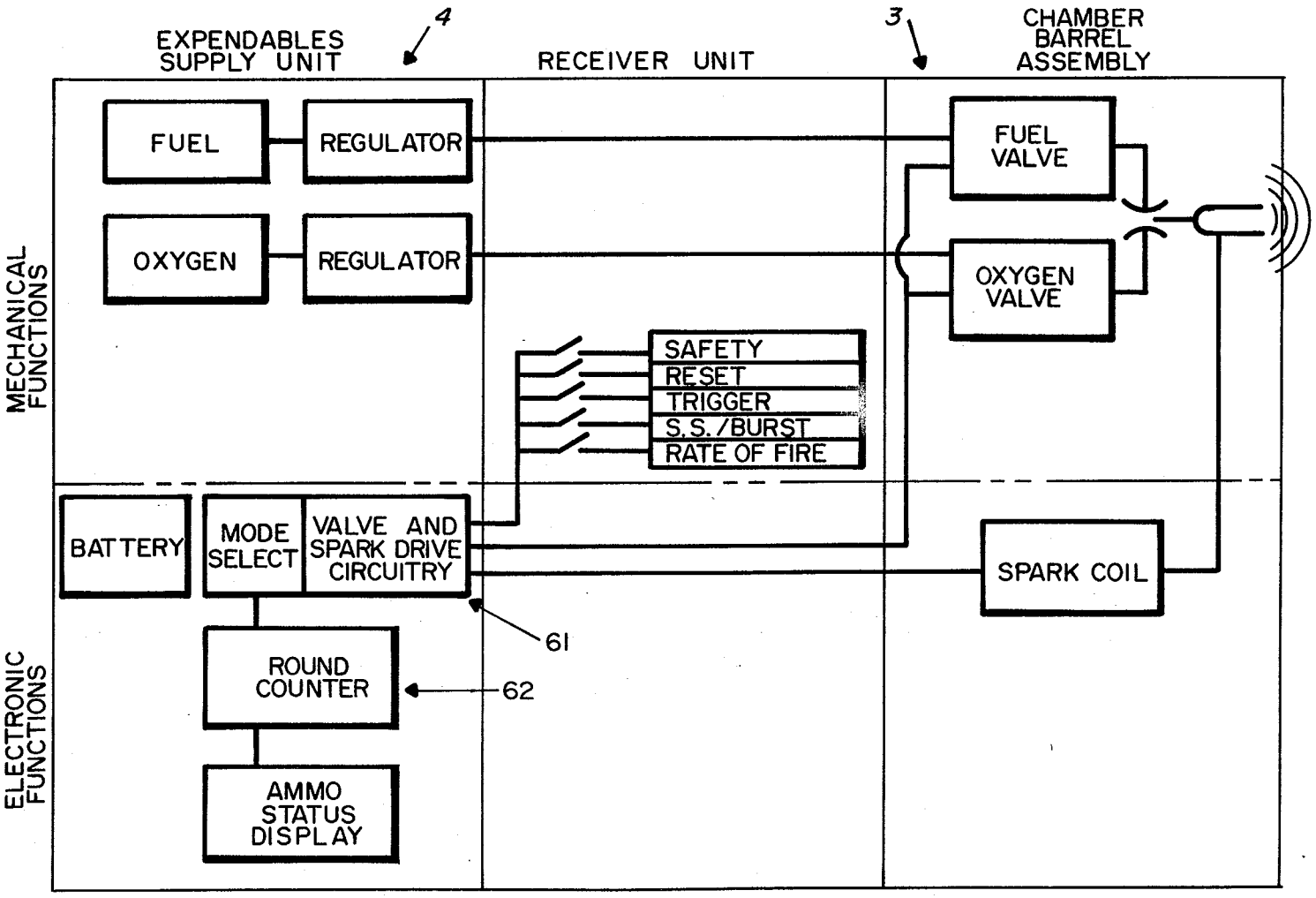
FIG. 2 is a block diagram showing the interrelationship of the expendables supply unit, the receiver unit and the chamber barrel assembly.

The principal elements of the AWESS converted weapon consist of the receiver unit 2, the chamber barrel assembly 3, and the expendables supply unit 4. The AWESS functions performed by each of these elements is shown in the AWESS block diagram FIG. 2. The expendables supply unit will be described with reference to FIGS. 1 and 2 for two embodiments of the present invention.

The chamber barrel assembly will be described with reference to FIGS. 1, 2, 7A, 7B and 7C and 7D for two embodiments of the present invention.

The receiver unit 2 will be described below with reference to FIGS. 1, 2, 3, 4, 5 and 6 for the first embodiment of the invention and in FIGS. 8, 9, 10, 11, 12, 13 and 14 for the second embodiment of the invention.

Figure 3:
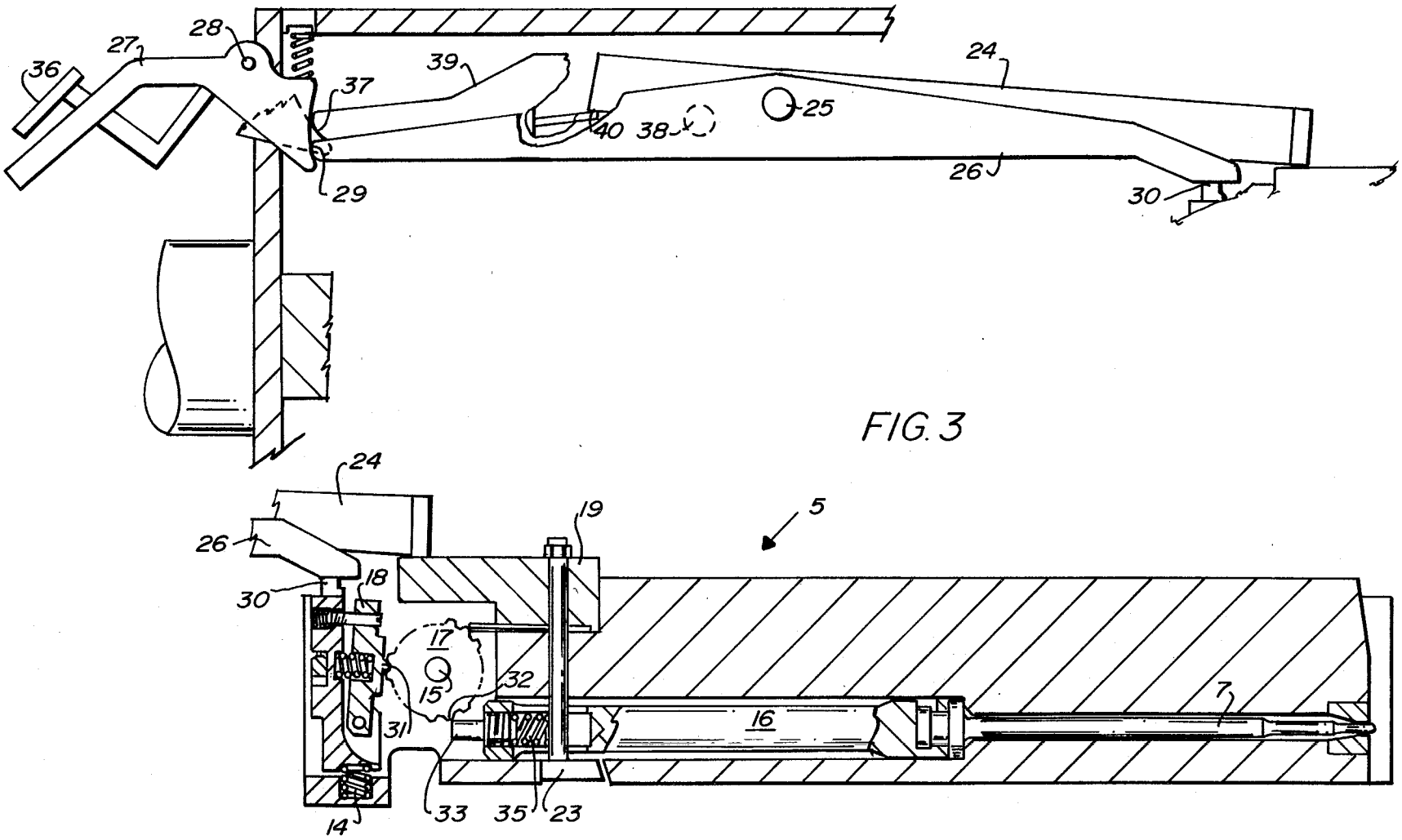
FIG. 3 is a side elevation view in cross section showing one embodiment of the AWESS constructed in accordance with the present invention and incorporated in the receiver of the M2 weapon.
Figure 4:
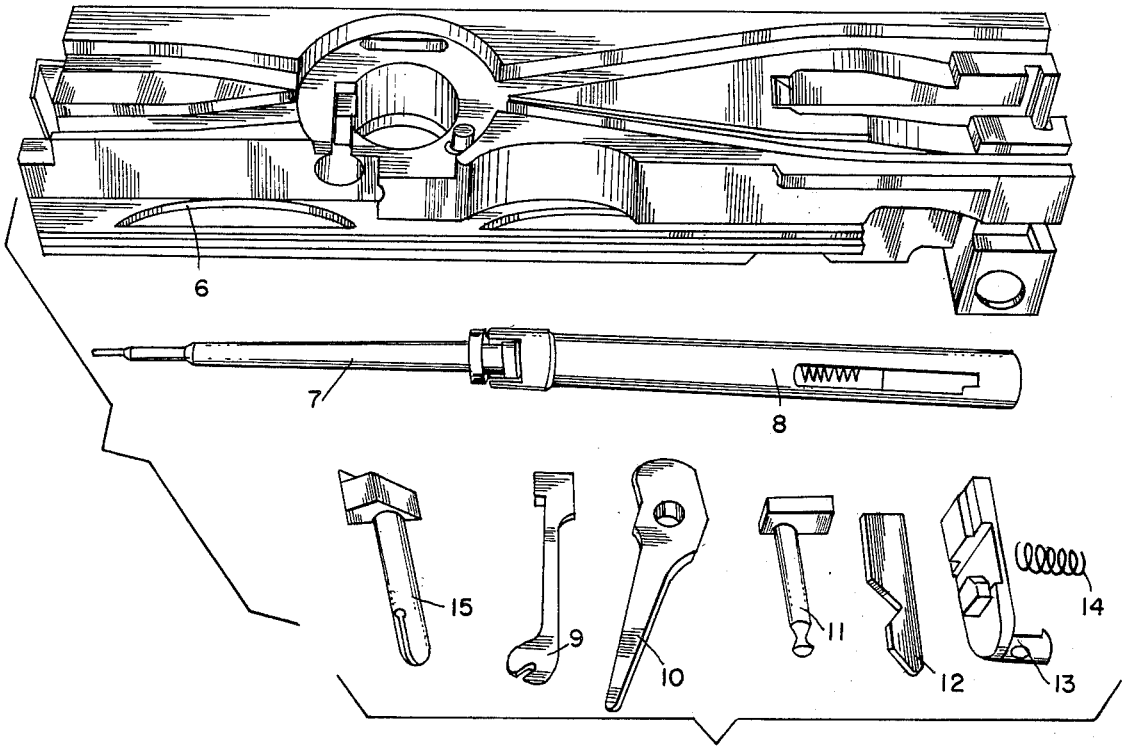
FIG. 4 is a disassembled view of the M2 bolt assembly.

The first embodiment of the invention, for converting a Cal .50 M2 machine gun to AWESS operation, is shown in FIG. 3 for the receiver unit. The bolt assembly 5 of the weapon (see FIG. 4) is removed as accomplished in normal field stripping of the weapon. The bolt assembly 5 is dissembled as shown in FIG. 4. The weapon bolt assembly 5 is comprised of the bolt body 6, firing pin 7, firing pin extension 8, stop keeper 9, cocking lever 10, sear stop pin 11, sear lock bar 12, sear 13, sear spring 14, and cocking lever pin 15.

Figure 5:
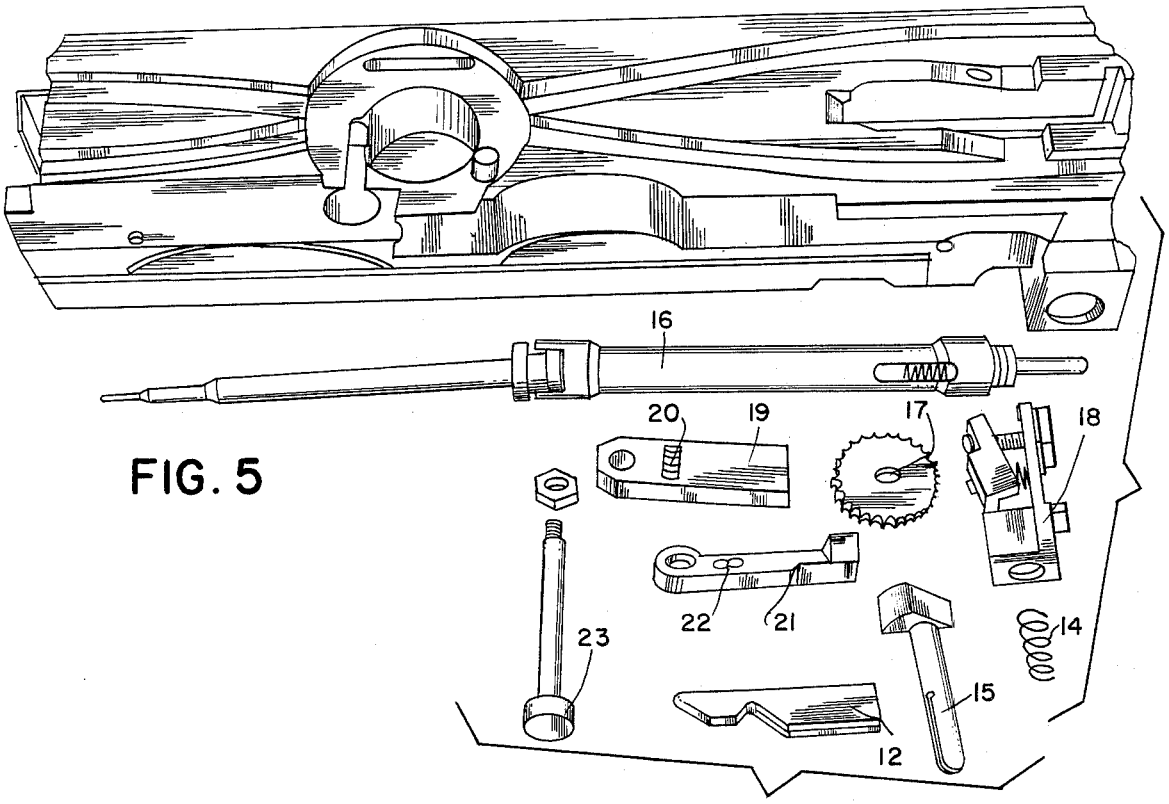
FIG. 5 is a view like FIG. 4 but showing the component parts used in the AWESS for the M2.

As shown in FIG. 5 the bolt of the machine gun is converted to AWESS operation by substituting the following AWESS components for those in the weapon bolt: the AWESS firing pin extension 16, ratchet wheel 17, sear assembly 18, burst fire cam base 19, return spring 20, burst fire cam 21, burst fire cam pin 22, and AWESS sear stop pin 23.

Figure 6:
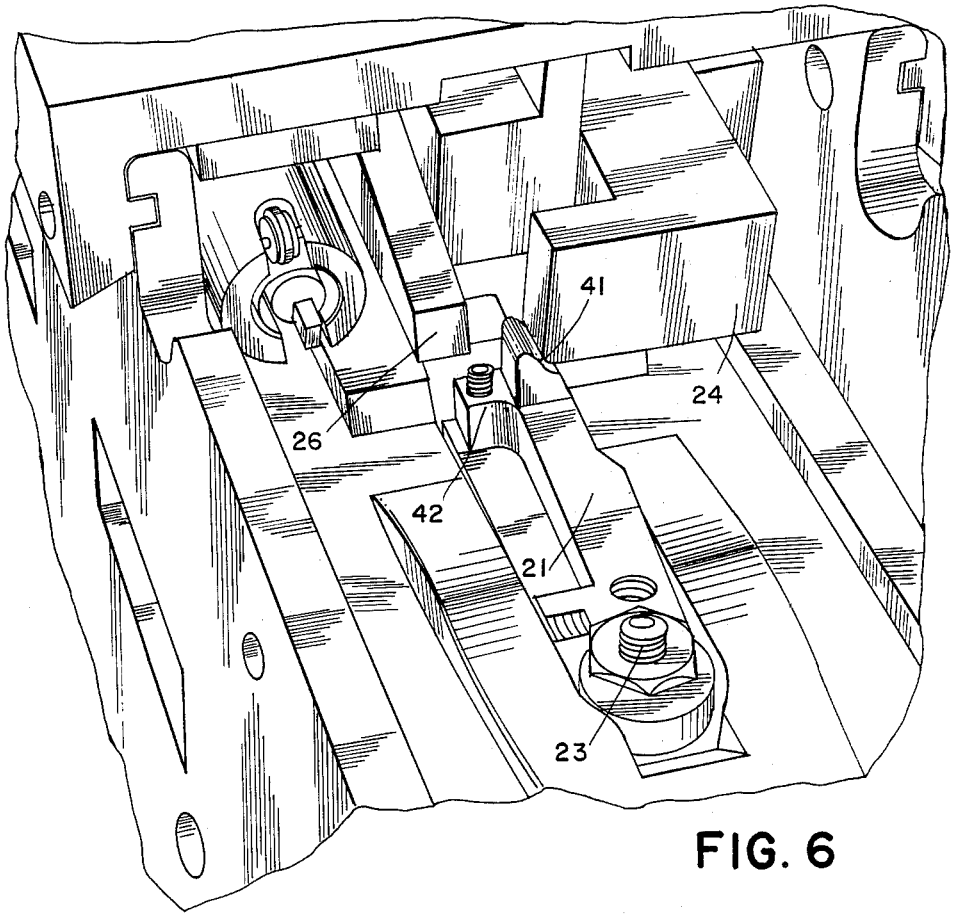
FIG. 6 is a view showing the action of the burst fire bar used to achieve burst fire operation in the M2.

Operation of the AWESS equipped machine gun receiver unit is shown in FIG. 3 and FIG. 6. The AWESS parts shown in FIGS. 5 and 6 have been incorporated into the bolt. The only other AWESS part added to the weapon receiver is the burst fire bar 24 (see FIG. 3), which pivots about the weapon's trigger lever pin 25.

The receiver unit is pictured in FIG. 3 with the bolt forward as it would be when the weapon is fired. In order to fire AWESS in the single shot mode trigger 27 is depressed, rotating about pin 28 and causing trigger lever cam surface 29 to engage trigger lever 26 which in turn rotates about pin 25. The forward cam surface 30 of the trigger lever depresses AWESS ratchet assembly 18 against return spring 14. In its downward motion ratchet pawl 31 engages a tooth of ratchet wheel 17 causing the ratchet wheel to rotate one tooth. Another tooth 32 of the ratchet wheel engages the cam surface 33 of the firing pin extension 16 causing the firing pin extension 16 and firing pin 7 to translate axially forward. It is the action of firing pin 7 against the firing pin rod 34 of the chamber-barrel assembly shown in FIG. 7A below, which completes the electrical circuit to effect operation of AWESS. The rod 34 is returned to its initial position, when the trigger is released by the action of the compression spring 60.

After ratchet wheel 17 is rotated one tooth, the action of return spring 35 returns firing pin 7 and firing pin extension 16 to its original position. Release of trigger 27 allows rotation of trigger bar 26 to free the ratchet assembly 18 which is returned to its original position by return spring 14.

In order that the AWESS equipped weapon operates in exactly the same manner as would the weapon alone, the trigger 27 and bolt latch release 36 must function the same in both modes of operation. In automatic fire full depression of the trigger 27 engages the bolt latch release 36 causing its cam surface 37 to rotate the bolt latch 39 about its pin 38.

In the weapon, rotation of the bolt latch prevents the bolt from being latched in its rearmost position. In the AWESS equipped weapon rotation of the bolt latch 39 engages cam surface 40 of the AWESS burst fire bar 24 which has been added to the weapon receiver when AWESS parts are substituted into the bolt. Burst fire bar 24 rotates about the trigger lever pin 25 as does the trigger lever 26.

Burst fire operation is achieved by restricting the rotation of ratchet wheel 17 such that tooth 32 does not rotate far enough to disengage cam surface 33.

As shown in FIG. 6, limited rotation of the ratchet wheel 17 is achieved by limiting the motion of the trigger bar 26 which actuates sear assembly 18. This is achieved by downward rotation of the burst fire bar, which is actuated by the bolt latch 39 and bolt latch release 36. The burst fire bar 24 bears against cam surface 41 of the burst fire cam 21 causing it to rotate about sear stop pin 23 such that trigger bar stop 42 is moved under trigger bar 26 to limit its travel. This in turn limits the travel of sear assembly 18 and rotation of ratchet wheel 17.

Operation of the chamber barrel assembly 3 is effected by the firing pin 7 of the receiver unit and its associated interaction with the expendables supply unit. The chamber barrel assembly is attached to the weapon receiver in exactly the same manner as is the weapon barrel. To achieve interchangeability between weapons an adapter 43 designed to mate with the proper element in the weapon receiver is attached to the chamber barrel assembly 3 by means of set screw 44. When the chamber barrel assembly is installed in the weapon receiver, firing pin rod 34 is in exact alignment with firing pin 7 such that mechanical motions of the firing pin in the weapon receiver are transmitted to firing pin rod 34 in the chamber barrel assembly.

Translation of firing pin rod 34 closes trigger switch 45 which actuates the electronic circuitry and gas valves 51 and 52 shown in FIG. 7D which supply propane, oxygen, and electric spark to the combustion chamber. As shown in FIG. 1, oxygen, propane and electrical power for operation of the spark coil 50 oxygen valve 51 and propane valve 52 are transmitted from the expendables supply unit 4 by flexible hoses and electrical lines 53 to the chamber barrel assemby 3 where the lines are connected to the chamber barrel assembly by electrical, propane, and oxygen quick connects 54, 55, 56 respectively.

When trigger switch 45 is closed solenoid valves 51 and 52 are energized allowing propane and oxygen to flow through the mixing venturi 57 and then into combustion chamber 49, via passage 58, where the mixed gases are ignited by spark plug 59. Normally, in simulated automatic fire, solenoid valves 51 and 52 are held open during a burst with the simulated rate of fire being established by the repetition rate of the spark plug. If desired, however, the solenoid valves can be made to operate each shot.

In order to simulate the time delay associated with reloading the weapon, after firing out one ready load of ammunition, the valve and spark drive circuitry 61 is disabled after reaching a preset number of rounds set into round counter 62. A timing circuit,in the electronics,actuated by switch 47 disables the valve and spark drive circuitry for a period which simulates time to reload the weapon.

As shown in FIG. 7A reset rod 63 bears against bolt face 62 when the bolt assembly 5 is in the forward or closed position. When the bolt is retracted by means of the weapon operating handle reset rod 63 moves rearward due to action of reset rod spring 64 causing switch 47 to open. The bolt must be retracted to simulate loading and cocking of the weapon associated with replenishing the ammunition supply. The delay circuit is energized preventing firing of the simulator for the prescribed time period. The simulator cannot be fired until the bolt is returned to the firing position and switch 47 is again closed.

FIG. 7B shows the M2 AWESS adaptor 43, and FIG. 7C shows the adaptors 65, 66, 67 and 68 for the M85 AWESS as well as the quick disconnects 54, 55 and 56 for the electrical cable and the two gases.

An AWESS constructed in accordance with another embodiment of the invention is illustrated in FIGS. 8–14. This embodiment of the invention demonstrates the ability of AWESS to be applied to a second weapon with only a change in the receiver unit and minor change in the barrel adapter of the combustion chamber barrel assembly. In this embodiment the AWESS is applied to the M85 Cal .50 machine gun which incorporates two additional functions that are not part of the M2 Cal .50 weapon. The two additional functions are dual rate of fire and a weapon safety.

Figure 8:
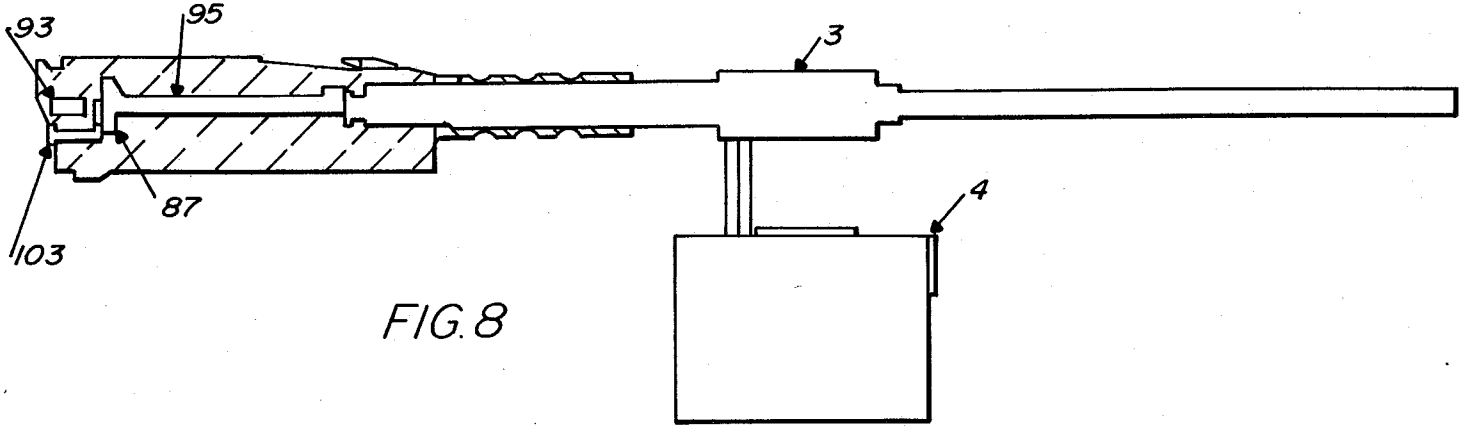
FIG. 8 is a schematic view showing the interrelationship of the three units (the expendables supply unit, the barrel assembly unit and the receiver unit) of a simulator integrated in an M85 weapon in accordance with another embodiment of the invention.

The AWESS applied to the M85 machine gun is shown schematically in FIG. 8. The expandbles supply unit 4 is unchanged. The only changes made to the combustion chamber barrel assembly are the substitution of new adapter elements 65, 66, 67 and 68 (see FIG. 7C) which permit the combustion chamber barrel assembly to be used in the M85 machine gun receiver.

As with the first embodiment described above, the adaptation of AWESS to the M85 receiver unit requires changes in the original bolt assembly of the actual weapon. The existing M85 machine gun bolt assembly is shown in FIG. 9. The parts of the bolt removed and retained for AWESS operation are shown in FIG. 10. Components removed from the bolt assembly include retaining pin 69, pins 70, cartridge case retainer 71, helical compression spring 72, spring insert 73, bolt lock 74, 75, extractor pin 76, cartridge extractor 77, compression spring 78, spring insert 79, pin 80, cartridge rammer 81, compression spring 82, spring insert 83, bolt block 84, and firing pin 85. The bolt slide 86 is retained in the receiver unit for AWESS operation.

Figure 11:
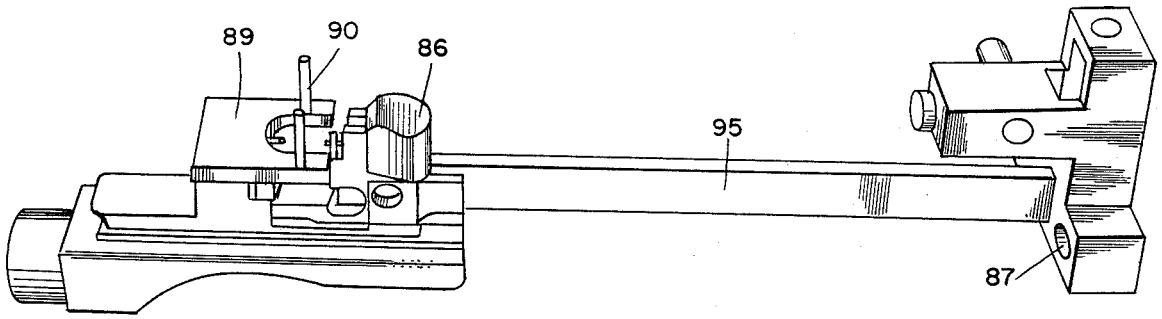
FIG. 11 shows the bolt slide which is retained and the AWESS elements which are introduced into the receiver for the M85.

The AWESS receiver unit for M85 machine gun operation is shown in FIG. 11. The receiver unit is comprised of a rear receiver block 87, trigger bar 95 and forward receiver block 89, held to the barrel extension of the weapon by pins 90. Trigger bar 95 passes through an opening 96 in bolt slide 86.

Figure 12:
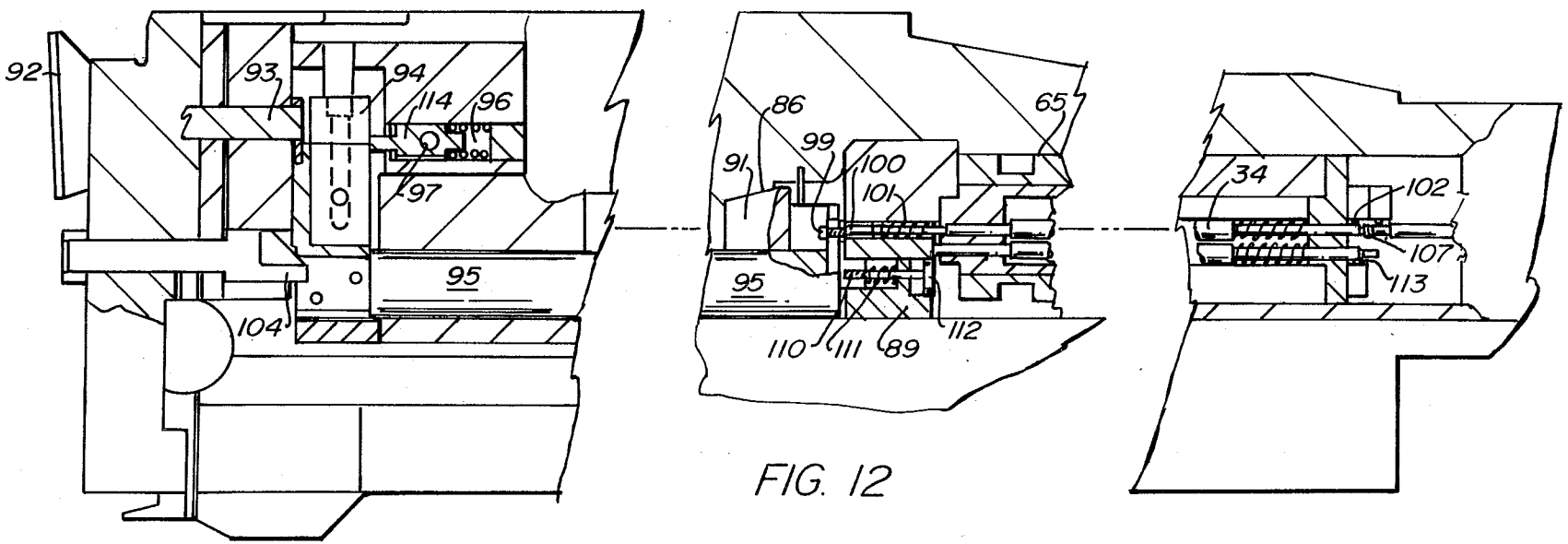
FIG. 12 is an elevation view in cross section showing the elements for the M85.

The AWESS receiver unit is shown mounted in the M85 weapon receiver, for low rate of fire operation,in FIG. 12. Firing of the AWESS equipped M85 machine gun is initiated by depressing the weapon trigger 92 which can be manually or solenoid operated. Motion of trigger 92 causes trigger pin 93 to translate forward and contact the AWESS trigger bar extension 94 causing forward motion of the trigger bar 95. The trigger bar extension 94 contacts the AWESS safety plunger 114 which operates against helical spring 96. Spring 96 returns the trigger bar to its rearmost position when the weapon trigger is released.

A hole 97 in the safety plunger 114 accepts pin 98 of the safety assembly shown in FIG. 13. In the "off" position pin 98 does not extend sufficiently to engage hole 97 in safety plunger 114. In the "on" position pin 98 engages hole 97 preventing motion of the safety plunger and hence motion of the trigger bar.

At the forward end of the trigger bar adjustable screw 99 engages trigger plunger 100, which operates within the forward receiver block 89, against compression spring 101. Motion of trigger bar 95 is thus transferred through plunger 100 to firing pin rod 34, acting against compression spring 60. As shown in FIG. 12 for low rate of fire operation cam surface 102 on rod 34 actuates low rate of fire switch 45.

Figure 14:
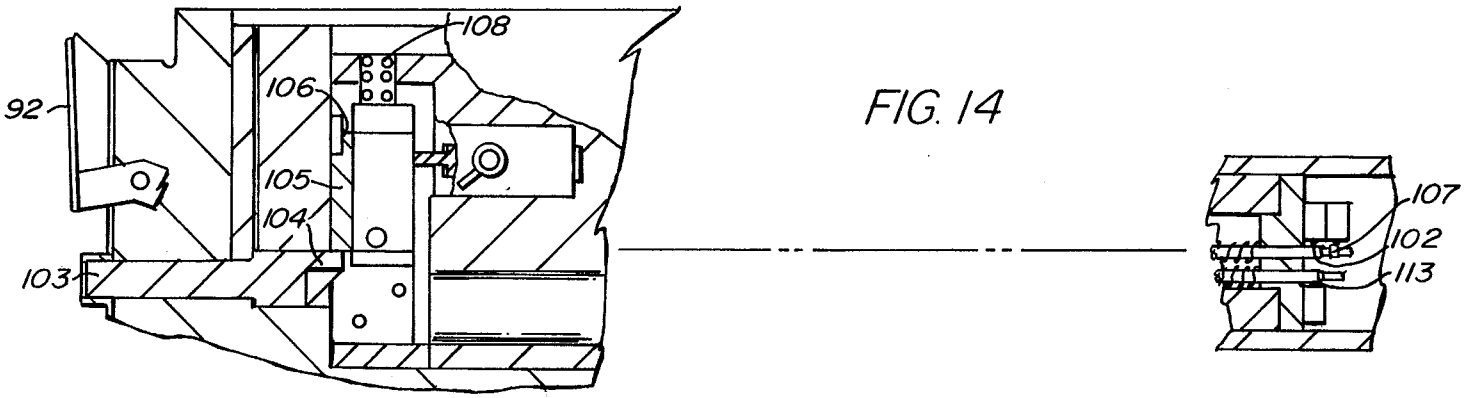
FIG. 14 is a view like FIG. 12 but shows the M85 elements in the high rate of fire mode of operation.

High rate of fire operation of the AWESS equipped M85 is shown in FIG. 14. The weapon rate selector switch 103 located on the rear surface of the weapon receiver is rotated to the high rate of fire position which rotates cam surface 104 to the position shown in FIG. 14. Engagement of cam surface 104 with AWESS high rate of fire slide 105 brings cam surfacd 106 in line with weapon trigger pin 93 which eliminates the gap, for low rate operation, existing between pin 93 and cam surface 106.

The AWESS high rate of fire slide 105 reacts against compression spring 108 which keeps slide 105 engaged with weapon cam 104.

In normal operation of the weapon, without AWESS, surface 104 does not function as a cam surface. This illustrates how in the present invention weapon functions are changed to effect AWESS integration and operation.

The full stroke of firing pin 93 is now effective which is transferred through trigger bar 95 and plunger 100 to firing pin rod 34. The additional stroke of firing pin rod 34 brings high rate cam surface 107 in contact with switch 46 which closes. This closing changes the resistance in the timing circuit to double the spark repetition rate for high rate of fire operation.

The reset function of the M85 is effected by contact of cam surface 109 on bolt slide 86 with reset bar 110. Bar 110 operates plunger 112 against compression spring 111. Plunger 112 engages reset rod 63 and translates it forward against compression spring 64. With the bolt slide 86 and reset rod 63 in the forward position cam surface 13 closes reset switch 47. When the bolt is retracted by means of the weapon operating handle, switch 47 is opened and the reset cycle with its specified time delays is initiated as described above for AWESS operation in the M2 weapon.

While I have illustrated and described the preferred embodiments of my invention, it is to be understood that these are capable of variation and modification, and I therefore do not wish to be limited to the precise details set forth, but desire to avail myself of such changes and alterations as fall within the purview of the following claims.

I claim:

1. A weapon of the kind used for combat troop engagement simulation and comprising, an automatic weapon having certain original parts removed, automatic weapons effects simulator (AWESS) means integrated directly into the weapon in place of the removed original parts for producing the visual and acoustic signatures associated with firing of the weapon while allowing the weapon operator to operate and utilize the basic weapon mechanism in the same manner as with the original parts, but without firing projectiles from the weapon, said AWESS means comprising, expendables supply means for supplying expendables including fuel, oxygen and batteries necessary for operation of the AWESS means, chamber barrel assembly means for providing a combustion chamber and related apparatus used to produce the visual and acoustic signatures, and receiver unit means for containing the elements and functions which most directly interact with weapon operation, such as, for example, trigger, safety, rate of fire switch, single shot, and burst fire operation.

2. The invention defined in claim 1 including adapter means for permitting a single AWESS means to be used in more than one type of weapon.

3. The invention defined in claim 2 wherein the chamber barrel assembly means include a firing pin rod and wherein the adapter means cause the firing pin rod to be in exact alignment with the firing pin of the weapon receiver such that mechanical motions of the firing pin in the weapon receiver are transmitted to the firing pin rod in the chamber barrel assembly means.

4. The invention defined in claim 1 wherein the fuel is a liquid fuel and the chamber barrel assembly means include electric spark means for igniting the fuel and the oxygen in the combustion chamber so that the simulated operation of the weapon is obtained at low cost as compared to the cost of blank ammunition.

5. The invention defined in claim 3 wherein the expendables supply means comprise fuel and oxygen pressure regulators required to establish gas pressures necessary for proper combustion and spark drive circuitry for controlling the electric spark means.

6. The invention defined in claim 5 including timing circuit means for disabling the spark drive circuitry for a period which simulates the time to reload the weapon.

7. The invention defined in claim 3 wherein the chamber barrel assembly means includes fuel and oxygen flow control valve and switches for trigger, rate of fire and reset.

8. The invention defined in claim 1 wherein the AWESS means are incorporated in an M85 machine gun for operation with the bolt slide and operating handle of the M85 weapon.

9. The invention defined in claim 8 wherein the receiver unit means include cam and switch means for doubling the spark repetition rate for high rate of fire operation as compared to low rate of fire operation.

10. the invention dfined inclaim 1 wherein the AWESS means includes burst fire bar means which pivot about a trigger lever pin of the weapon to permit operation in a single shot mode or in a burst fire mode with full depression of the trigger in exactly the same manner as occurs by operation of the trigger in the actual weapon without the AWESS means.

11. The invention defined in claim 1 wherein the chamber barrel assembly means include valve means controlling the flow of fuel and oxygen to the combustion chamber, electric spark means for igniting the mixture of fuel and oxygen in the combustion chamber, and including spark drive circuitry for controlling the electric spark means and wherein the valve means are actuated to an open position to provide a continuous flow of fuel and oxygen to the combustion chamber and the spark drive circuitry controls the rate of repetition of firing of the weapon by intermittent sparks.

12. A method of simulating operation of a weapon of the kind used for combat troop engagement simulation in a way that requires normal weapon operation to produce the simulated operation, said method comprising, removing certain original parts from an automatic weapon, replacing the removed original parts with automatic weapons effects simulator AWESS parts which include a combustion chamber, and integrating the AWESS parts directly into the weapon to produce the visual and acoustic signatures associated with firing of the weapon while allowing the weapon operator to operate and utilize the basic weapon mechanism in the same manner as with the original parts, but without firing projectiles from the weapon.

13. The invention defined in claim 12 including injecting a liquid fuel and oxygen into a combustion chamber and igniting the mixture in the combustion chamber by an electric spark to produce the visual and acoustic signatures at low cost as compared to the cost of producing such signatures by blank ammunition.

14. The invention defined in claim 11 including supplying a continuous feed of fuel and oxygen to a combustion chamber of the weapon and controlling the simulated rate of fire by controlling a spark repetition in the combustion chamber.

* * * * *